US008657398B2

(12) United States Patent
Tamura

(10) Patent No.: US 8,657,398 B2
(45) Date of Patent: Feb. 25, 2014

(54) LIQUID EJECTING APPARATUS AND LIQUID EJECTING METHOD

(75) Inventor: Noboru Tamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 148 days.

(21) Appl. No.: 13/422,991

(22) Filed: Mar. 16, 2012

(65) Prior Publication Data

US 2012/0236053 A1 Sep. 20, 2012

(30) Foreign Application Priority Data

Mar. 18, 2011 (JP) ..... 2011-061377

(51) Int. Cl.
*B41J 29/38* (2006.01)

(52) U.S. Cl.
USPC ..... 347/10; 347/9

(58) Field of Classification Search
USPC ..... 347/5, 9, 10, 12, 14, 19, 23, 40, 44, 47
See application file for complete search history.

(56) References Cited

U.S. PATENT DOCUMENTS

| | | | | |
|---|---|---|---|---|
| 6,334,668 | B1 | 1/2002 | Isamoto | |
| 6,338,537 | B1 | 1/2002 | Nou | |
| 7,252,355 | B2 * | 8/2007 | Umeda | 347/10 |
| 7,258,408 | B2 * | 8/2007 | Usuda | 347/11 |

FOREIGN PATENT DOCUMENTS

| | | | |
|---|---|---|---|
| JP | 2000-203014 | A | 7/2000 |
| JP | 2000-343690 | A | 12/2000 |
| JP | 2002-059543 | A | 2/2002 |
| JP | 2009-196121 | A | 9/2009 |

* cited by examiner

*Primary Examiner* — Juanita D Jackson
(74) *Attorney, Agent, or Firm* — Maschoff Brennan

(57) ABSTRACT

A liquid ejecting apparatus including, a control unit including a digital signal generation unit which generates a digital signal defining the shape of the signal waveform, an analog voltage signal generation unit which generates an analog voltage signal on the basis of the digital signal, and a current signal generation unit which generates a current signal of a magnitude corresponding to a waveform of the analog voltage signal, a head unit including, a voltage signal generation unit which generates a voltage signal by detecting a potential difference between two points which are different from each other in a path to which the current signal flows, and by amplifying the potential difference, and an element which is driven by the voltage signal, and causes liquid to be ejected from a nozzle, and a transmission unit which transmits the current signal to the head unit from the control unit.

7 Claims, 7 Drawing Sheets

LIQUID EJECTING APPARATUS AND LIQUID EJECTING METHOD

CROSS-REFERENCE TO RELATED APPLICATIONS

This application claims priority to Japanese Patent Application No. 2011-061377 filed on Mar. 18, 2011.

BACKGROUND

1. Technical Field

The present invention relates to a liquid ejecting apparatus and a liquid ejecting method.

2. Related Art

A liquid ejecting apparatus which performs recording of images or the like by ejecting liquid from a head unit, and landing a liquid droplet (dot) on a medium has been widely used. In addition, a method of causing a liquid to be ejected by applying a drive waveform signal to an element such as a piezoelectric element which is provided in the head unit, and by vibrating the piezoelectric element is well known, as a method of ejecting liquid from the head unit.

In such a liquid ejecting apparatus, a method of generating the drive waveform signal has been proposed (for example, in JP-A-2000-343690) in which a small amplitude voltage signal is input to a head unit through a cable such as a flexible flat cable (FFC) from a control unit which generates a predetermined voltage signal, and the voltage signal is power amplified in the head unit.

In the method described in JP-A-2000-343690, when a sufficiently large power capacitor is provided on the head, it is not necessary that a current with a large peak which instantly flows when driving the head flow in the cable, such as an FFC. That is, since an average current flows in the cable such as an FFC, it is possible to reduce the heat in the cable, and to reduce the number of cores in the FFC. However, there may be a case where it is not possible to generate a correct drive waveform signal in the head unit due to the influence of a disturbance such as noise in the transmission path (FFC), when a voltage waveform signal with a small amplitude is transmitted to the head unit from the control unit. In such as case, it is difficult to precisely control the amount of liquid ejecting.

SUMMARY

An advantage of some aspects of the invention is to provide a liquid ejecting apparatus which generates a drive waveform signal which is resistant to a disturbance, and is accurate.

According to an aspect of the invention, there is provided a liquid ejecting apparatus which includes, (A) a control unit including a digital signal generation unit which generates a digital signal defining the shape of the signal waveform, an analog voltage signal generation unit which generates an analog voltage signal on the basis of the digital signal, and a current signal generation unit which generates a current signal of a magnitude corresponding to a waveform of the analog voltage signal, (B) a head unit including, a voltage signal generation unit which generates a voltage signal by detecting a potential difference between two points which are different from each other in a path through which the current signal flows, and by amplifying the potential difference, and an element which is driven by the voltage signal, and causes liquid to be ejected from a nozzle, and (C) a transmission unit which transmits the current signal to the head unit from the control unit.

Other characteristics of the invention will be clarified using descriptions of the application and accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
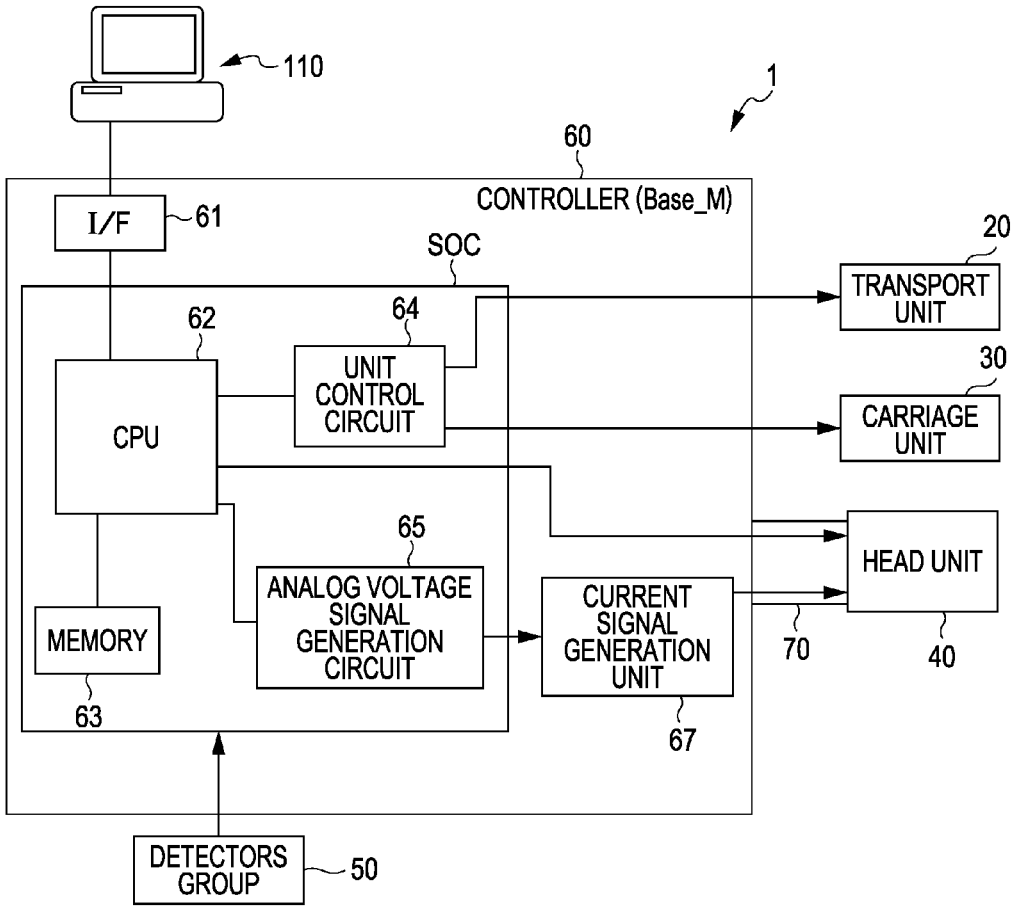
FIG. 1 is a block diagram which shows the entire configuration of a printer.

According to the descriptions of the application and accompanying drawings, at least the following facts will be clarified.

A liquid ejecting apparatus which includes, (A) a control unit including a digital signal generation unit which generates a digital signal defining the shape of the signal waveform, an analog voltage signal generation unit which generates an analog voltage signal on the basis of the digital signal, and a current signal generation unit which generates a current signal of a magnitude corresponding to a waveform of the analog voltage signal, (B) a head unit including, a voltage signal generation unit which generates a voltage signal by detecting a potential difference between two points which are different from each other in a path through which the current signal flows, and by amplifying the potential difference, and an element which is driven by the voltage signal, and causes liquid to be ejected from a nozzle, and (C) a transmission unit which transmits the current signal to the head unit from the control unit.

According to such a liquid ejecting apparatus, it is possible to generate a drive waveform signal which is resistant to a disturbance, and is accurate.

In the liquid ejecting apparatus, a potential of a point of the lower potential side may be set to be higher than a potential of GND, between the two different points which detect a potential difference.

According to such a liquid ejecting apparatus, it is easy to generate a more accurate drive waveform signal, since it is possible to suppress malfunctions of a voltage signal generation unit.

In the liquid ejecting apparatus, the transmission unit may have a path in which the current signal which is transmitted to the head unit from the control unit returns to the control unit from the head unit.

According to such a liquid ejecting apparatus, a further distortion-free transmission is performed when transmitting the current signal. In addition, it is possible to perform a differential transfer in which the influence of noise is further reduced.

In the liquid ejecting apparatus, the control unit may have a chip in which the digital signal generation unit and the analog voltage generation unit are integrally formed.

According to such a liquid ejecting apparatus, since there is little possibility of being affected by noise in the process of transmitting a digital signal (DAC value), it is easy to generate a drive waveform signal COM having a waveform of an accurate shape.

In the liquid ejecting apparatus, the control unit may have a chip in which the digital signal generation unit, the analog voltage signal generation unit, and the current signal generation unit are integrally formed.

According to such a liquid ejecting apparatus, it is easy to generate the drive waveform signal COM having an accurately shaped waveform, since there is little possibility of being affected by the noise in the process of transmitting the digital signal (DAC value), or an analog voltage signal (COM'). In addition, it is possible to reduce the cost by reducing the number of parts of the control unit.

In the liquid ejecting apparatus, there is a resistance in a path through which the current signal flows, and the difference in a potential which is generated at both ends of the resistor may be detected when the current signal flows through the resistor.

According to such a liquid ejecting apparatus, it is possible to detect the potential difference simply and accurately.

In addition, a liquid ejecting method is clarified, which includes, generating a digital signal which defines the shape of a signal waveform, generating an analog voltage signal on the basis of the digital signal, generating a current signal of a magnitude corresponding to the waveform of the analog voltage signal, transmitting the generated current signal to a head unit, generating a voltage signal by detecting a potential difference between two different points of a path through which the current signal flows, and amplifying the potential difference, and causing liquid to be ejected from a nozzle by driving an element using the voltage signal.

Embodiments

An ink jet printer (printer 1) will be exemplified as an embodiment of the liquid ejecting apparatus.

Configuration of Printer

FIG. 1 is a block diagram which shows the entire configuration of a printer 1. The printer 1 is a liquid ejecting apparatus which records (prints) characters or images on a medium such as paper, cloth, film, or the like, and is communicably connected to a computer 110 as an external device.

A printer driver is installed to the computer 110. The printer driver is a program which displays a user interface on a display device (not shown), and converts image data which is output from an application program to print data. The printer driver is recorded in a recording medium such as a flexible disk FD, or a CD-ROM (a computer readable recording medium). In addition, the printer driver is also able to be downloaded to the computer 110 through the Internet. Further, the program is configured of code for implementing a variety of functions.

The computer 110 outputs print data corresponding to an image to be printed to the printer 1, in order to print the image in the printer 1. The print data is data of a format which can be interpreted by the printer 1, and has various command data items, and image data SI. The command data is data for instructing the execution of a specified operation to the printer 1. As the command data, for example, there are command data for instructing paper feeding, command data for denoting transport amount, and command data for instructing paper discharging. In addition, the image data SI is data relating to pixels of the image to be printed. Here, the pixel is a unit element which configures the image, and the image is configured when the pixels are two-dimensionally arranged. The image data SI in the print data is data relating to dots (for example, a grayscale value) which are formed on the medium (for example, paper S, or the like). The pixel data is configured by, for example, two bits of data for each pixel. The two bits of pixel data can represent one pixel with four types of grayscale. That is, for example, there are data [00] which corresponds to no dot, data [01] which corresponds to a small dot, data [10] which corresponds to a formation of a medium dot, and data [11] which corresponds to a large dot.

The printer 1 includes a transport unit 20, a carriage unit 30, a head unit 40, a detector group 50, a controller 60, and a transmission unit 70. The controller 60 controls each unit such as the head unit 40 or the like on the basis of the print data which is received from the computer 110 as the external device, and prints images on the medium. Conditions in the printer 1 are monitored by the detector group 50, and the detector group 50 outputs the detection result to the controller 60. The controller 60 controls each unit on the basis of the detection result which is output from the detector group 50.

Transport Unit 20

Figure 2A:
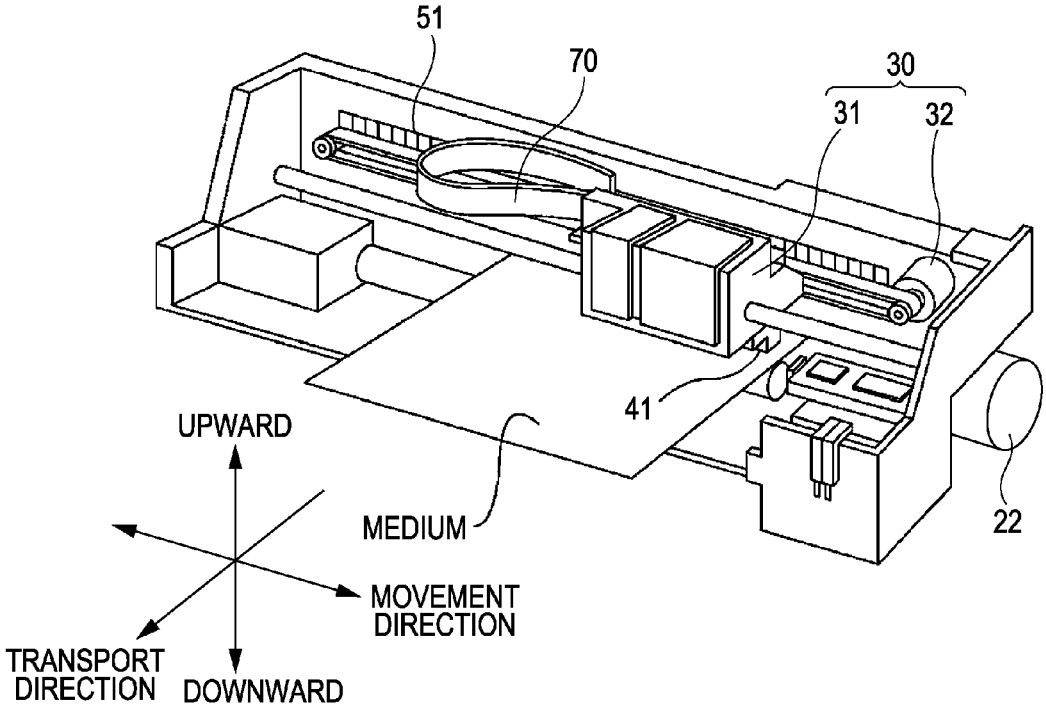
FIG. 2A is a diagram which describes a configuration of the printer according to the embodiment.
Figure 2B:
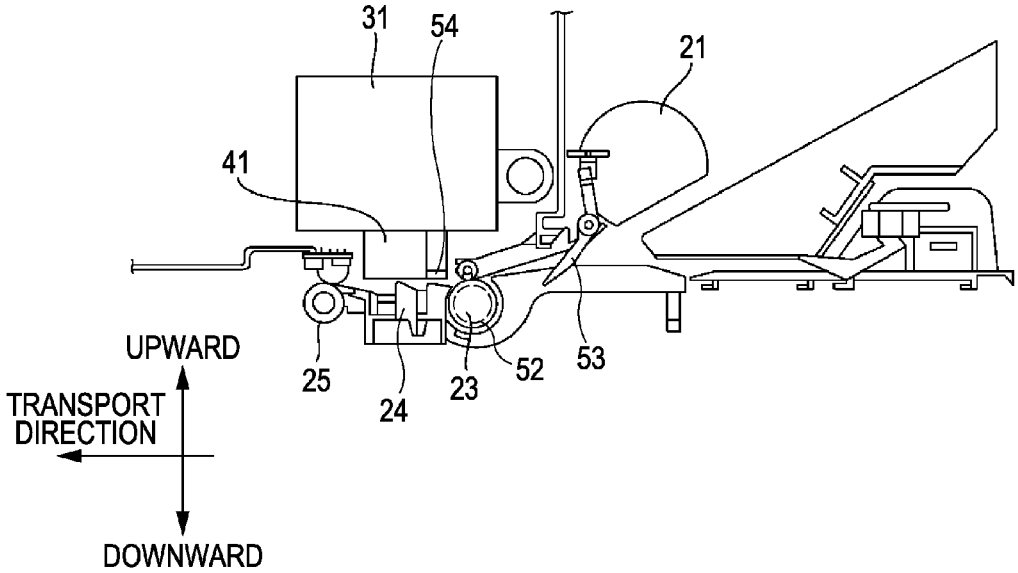
FIG. 2B is a side view which describes the configuration of the printer according to the embodiment.

FIG. 2A is a bird's-eye view which denotes a configuration of the printer 1 according to the embodiment, and FIG. 2B is a side view which denotes the configuration of the printer 1.

The transport unit 20 is a unit for transporting a medium (for example, the paper S, or the like) to a predetermined direction. Here, the transport direction is the direction which intersects the movement direction of a carriage. The transport unit 20 includes a paper feeding roller 21, a transport motor 22, a transport roller 23, a platen 24, and a paper discharge roller 25 (refer to FIGS. 2A and 2B).

The paper feeding roller 21 is a roller for feeding paper which is inserted in the paper insertion slot into the printer. The transporting roller 23 is a roller which transports the paper S which is fed by the paper feeding roller 21 to a printable region, and is driven by the transport motor 22. The operation of the transport motor 22 is controlled by the controller 60 on the printer side. The platen 24 is a member which supports the paper S during being printed from the rear side. The paper discharge roller 25 is a roller for discharging the paper S to the outside of the printer, and is provided on the downstream side with respect to the printable region in the transport direction.

Carriage Unit 30

The carriage unit 30 is a unit which moves a carriage 31 (hereinafter, referred to as "scanning") to which the head unit 40 is attached in a predetermined direction (hereinafter, referred to as movement direction). The carriage unit 30 includes the carriage 31, and a carriage motor 32 (also referred to as "CR motor") (refer to FIGS. 2A and 2B).

The carriage 31 is able to perform the reciprocating movement in the movement direction, and is driven by the carriage motor 32. The operation of the carriage motor 32 is controlled by the controller 60 on the printer side. In addition, the carriage 31 holds an ink cartridge which receives ink detachably.

Head Unit 40

The head unit 40 is a unit for ejecting ink to the paper S. The head unit 40 has a head 41 including a plurality of nozzles, and a head control unit HC. The head 41 is provided at the carriage 31, and moves in the movement direction, as well, when the carriage 31 moves in the movement direction. In addition, when the head 41 intermittently ejects ink during moving in the movement direction, dot lines (raster lines) are formed on the medium along the movement direction.

Figure 3:
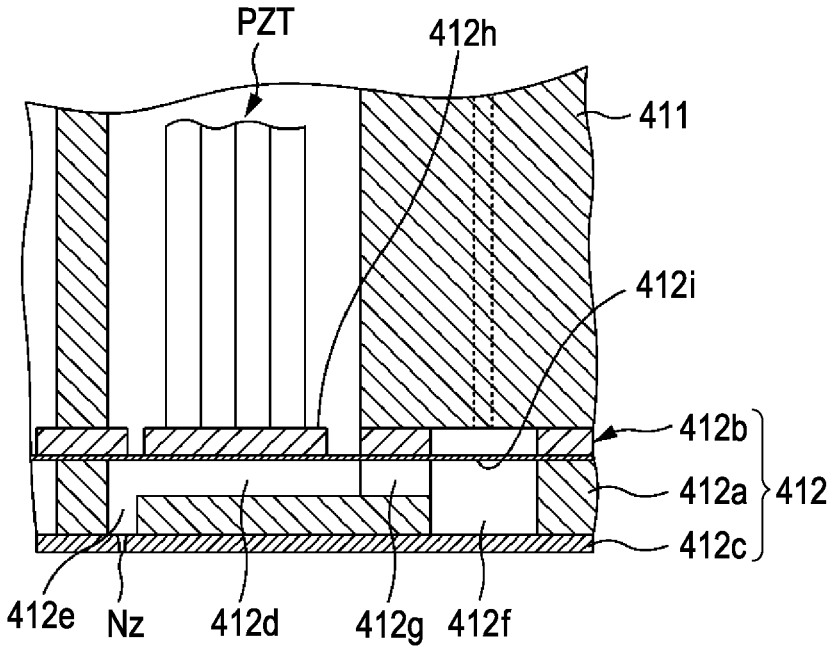
FIG. 3 is a cross-sectional view for describing a structure of a head.

FIG. 3 is a cross-sectional line which shows a structure of the head 41. The head 41 includes a case 411, a flow path unit 412, and a piezoelectric element group. The case 411 receives the piezoelectric element group, and the flow path unit 412 is bonded to the lower surface of the case 411. The flow path unit 412 includes a flow path forming plate 412*a*, an elastic plate 412*b*, and a nozzle plate 412*c*. A groove portion as a pressure chamber 412*d*, a through port as a nozzle communication port 412*e*, a through port as a common ink chamber 412*f*, and a groove portion as an ink supply path 412*g* are formed in the flow path forming plate 412*a*. The elastic plate 412*b* includes an island unit 412*h* to which the tip end of the piezoelectric element PZT is bonded. In addition, an elastic region which is formed by an elastic film 412*i* is formed at the periphery of the island unit 412*h*. Ink which is stored in the ink cartridge is supplied to the pressure chamber 412*d* which corresponds to each nozzle Nz through the common ink chamber 412*f*. The nozzle plate 412*c* is a plate on which the nozzle Nz is formed. On the nozzle surface, a yellow nozzle column Y which ejects yellow ink, a magenta nozzle column M which ejects magenta ink, a cyan nozzle column C which ejects cyan ink, and a black nozzle column K which ejects black ink are formed. In each nozzle column, a plurality of nozzles Nz is configured by being arranged in the transport direction at a predetermined interval.

The group of piezoelectric elements has the comb shaped plurality of piezoelectric elements PZT (driving element), and is provided by the number corresponding to the nozzle Nz. When the drive waveform signal COM as a voltage signal is applied to the piezoelectric element PZT by a wiring substrate (hereinafter, referred to as a head substrate Base_H) to which the head control unit HC, or the like is mounted, the piezoelectric element PZT expands and contracts (being driven) in the vertical direction according to the voltage signal. When the piezoelectric element PZT expands and contracts, the island unit 412*h* is pushed to the pressure chamber 412*d* side, or is pulled in the opposite direction. At this time, the elastic film 412*i* at the periphery of the island unit 412*h* is deformed, accordingly, the pressure in the pressure chamber 412*d* rises or falls, thereby ejecting ink droplets from the nozzle.

The head unit HC is a control IC for controlling driving of the group of piezoelectric elements PZT, and is provided on the head substrate Base_H which is fixed to the head 41. The head unit HC will be described in detail later.

Group of Detectors 50

The group of detectors 50 is a group form monitoring the conditions of the printer 1. The group of detectors 50 includes a linear encoder 51, a rotary encoder 52, a paper detection sensor 53, an optical sensor 54, or the like (refer to FIGS. 2A and 2B).

The linear encoder 51 detects a position of the movement direction of the carriage 31. The rotary encoder 52 detects the rotation amount of the transport roller 23. The paper detection sensor 53 detects the position of the tip end of the medium (paper S) during paper feeding. The optical sensor 54 detects the presence or absence of the medium at the opposite position using a light emitting unit and light receiving unit which are attached to the carriage 31, for example, and it is possible to detect the position of the tip end portion of the paper while moving. In addition, the optical sensor 54 is able to detect the leading end (the end portion on the downstream side in the transport direction, also referred to as the upper end), and the trailing end (the end portion on the upstream side in the transport direction, also referred to as the lower end), according to the situation.

Controller 60

The controller 60 is a unit for controlling (control unit) the printer 1. The controller 60 includes an interface unit 61, and an SOC (System-on-a-chip), and a current signal generation unit 67, and is mounted onto a main substrate Base-M which is fixed to the main body of the printer 1.

The interface unit 61 performs data transceiving between the computer 110 as the external device and the printer 1.

The SOC is a chip in which a CPU 62, a memory 63, a unit control circuit 64, and an analog voltage signal generation circuit 65 are integrally formed (refer to FIG. 1).

The CPU 62 is an arithmetic processing unit for controlling the entire printer 1. The memory 63 secures a region for storing a program of the CPU 62, or an operation region, and is configured by a storage element such as a RAM, and an EEPROM. In addition, the CPU 62 controls each unit such as the transport unit 20, the carriage unit 30, or the like, through the unit control circuit 64 according to the program which is stored in the memory 63.

In addition, the CPU 62 generates a digital signal which defines the shape of the waveform of the signal including a predetermined waveform, and outputs the digital signal to the analog voltage signal generation unit 65 in the SOC. The digital signal is referred to as a DAC value, and corresponds to waveform information for determining the waveform of the drive waveform signal COM which drives the piezoelectric element PZT. That is, the CPU 62 corresponds to a digital signal generation unit for generating the digital signal (DAC value).

In addition, the CPU 62 generates a variety of control signals such as a latch signal LAT, a change signal CH, a transfer clock signal SCK, and outputs the signals to the head unit 40. These control signals are used when generating a SW signal which controls applying of the above described pixel data SI and the drive waveform signal COM to the piezoelectric element PZT, in the head unit HC to be described later.

The analog voltage signal generation circuit 65 is an analog waveform signal generation unit which generates an analog voltage signal COM' which is a voltage change pattern as a base of the drive waveform signal COM, on the basis of the digital signal (DAC value) which is input from the CPU 62. The analog voltage signal generation circuit generates the analog voltage signal having a waveform corresponding to the value of the digital signal so that, for example, the larger the value of the digital signal, it becomes the higher voltage, and the smaller the value of the digital signal, it becomes the lower voltage, regarding the digital signal (DAC value). According to the embodiment, the analog voltage signal COM' is a voltage waveform signal having a voltage of about 3.3 V.

As described above, according to the embodiment, since the CPU 62 and the analog voltage signal generation circuit 65 are integrally formed in the SOC, it is possible to generate the accurate analog voltage signal COM'.

When CPU 62 and the analog voltage signal generation circuit 65 are provided at separated positions as separate units, there may be a case where the DAC value is distorted due to an influence such as noise in the transmission path, when transmitting the digital signal (DAC value) which is generated in the CPU 62 to the analog voltage signal generation circuit 65. When the DAC value is distorted, it is difficult to form the accurate waveform, since the distortion is propagated to the analog voltage signal COM', as well, which is generated from the DAC value in the analog voltage signal generation circuit 65. Accordingly, it is difficult to control the ink ejection amount, since the drive waveform signal COM which is finally generated becomes incorrect. Accordingly, the operation of expansion and contraction of the piezoelectric element PZT is disturbed.

On the other hand, since the CPU 62 and the analog voltage signal generation circuit 65 are integrally formed as SOC, the possibility of being influenced by the noise during the transmission of the DAC value is very low. Accordingly, it is possible to generate the analog voltage signal COM' accurately, and to easily generate the drive waveform signal COM with the shape of accurate waveform.

The current signal generation unit 67 is a current signal generation unit which generates a current signal corresponding to a voltage signal. In other words, the current signal generation unit 67 also corresponds to a V/I conversion unit which converts a voltage signal to a current signal. In addition, the current signal generation unit 67 is a general V/I conversion unit which is configured by combining an operation amplifier, or a detector.

According to the embodiment, the current signal generation unit 67 generates a current signal corresponding to the COM' by performing the V/I conversion to the analog voltage signal COM' which is input from the analog voltage signal generation circuit 65, and outputs the current signal to the head unit 40 through a transmission unit 70 to be described later. Specifically, voltage waveform information is transmitted to the head unit 40 as information of the current value, by generating a current signal of a magnitude corresponding to the waveform (voltage) of the analog voltage signal COM'. A method of generating the drive waveform signal COM from the transmitted current signal will be described later.

In addition, the current signal generation unit 67 may be included in the SOC. That is, the SOC is a chip in which the unit control circuit 64, the analog voltage signal generation circuit 65, and the current signal generation unit 67 are integrally formed, and a generation process of the digital signal to the generation process of the current signal may be executed in one chip. In this manner, it is possible to suppress a possibility of the analog voltage signal COM' being influenced by the noise in a signal path between the analog voltage signal generation circuit 65 and the current signal generation unit 67. In addition, it is possible to reduce the number of parts in the controller 60.

Transmission Unit 70

The transmission unit 70 is configured by a plurality of transmission lines which connects the main substrate Base-M of the controller 60, and the head substrate Base_H of the head unit 40 to each other. The various control signals such as the current signal which is output from the controller 60, the pixel data SI, the latch signal LAT, the change signal CH, the transfer clock signal SCK, or the like, are transmitted to the head unit 40 side through each transmission line of the transmission unit 70. According to the embodiment, as the transmission unit 70, a flexible flat cable (hereinafter, also referred to as an FFC) as shown in FIG. 2B. The FFC is a ribbon-shaped transmission member in which a plurality of planar transmission lines are arranged in parallel, thereby integrally operating the plurality of planar transmission lines while making the thickness of the cable itself thin.

In addition, the FFC includes a transmission line for supplying electricity to the head unit 40 from the power (for example, the main power supply Vdd), a ground wire for applying a voltage of ground (GND), or the like. In addition, according to the embodiment, the potential difference between the main power supply Vdd and the ground is about 42 V.

Printing Operation of Printer

The operation of the printer 1 will be simply described. The controller 60 performs a process of paper feeding, dot forming, transporting, or the like, by receiving a print command from the computer 110 through the interface unit 61, and controlling each unit.

The paper feeding processes is a process in which paper to be printed is supplied into the printer, and the paper is positioned at the print start position (also referred to as a cue position). The controller 60 causes the paper feeding roller 21 to rotate, and sends the paper to be printed to the transport roller 23. Subsequently, the transport roller 23 is rotated, and the paper which is sent from the paper feeding roller 21 is positioned at the print start position.

The dot forming process is a process in which ink is intermittently ejected from a head which moves along the movement direction (scanning direction), and dots are formed on the paper. The controller 60 moves the carriage 31 in the movement direction, and causes ink to be ejected from the head 41 based on the print data while the carriage 31 is moving. When the ejected ink droplets are landed on the paper, dots are formed on the paper, and a dot line which is formed of the plurality of dots is formed on the paper along the movement direction.

The process is a process in which the paper is relatively moved along the transport direction with respect to the head. The controller 60 transports the paper in the transport direction by rotating the transport roller 23. By the process, the head 41 can form the dot at a position which is different from the position of the dot which is formed by the previous dot forming process.

The controller 60 alternately repeats the dot forming process and the process until there is no more data to be printed, and prints an image which is configured by the dot line little by little on the paper. In addition, when there is no more data to be printed, the paper is discharged by rotating the paper discharge roller 25. In addition, the determination of whether or not performing the discharge may be made on the basis of the paper discharge command which is included in the print data.

When subsequent printing is performed on the paper, the same process is repeated, and when the subsequent printing is not performed, the printing operation is ended.

Regarding Generation of Drive Waveform Signal COM

Description of Head Control Unit HC

Figure 4:
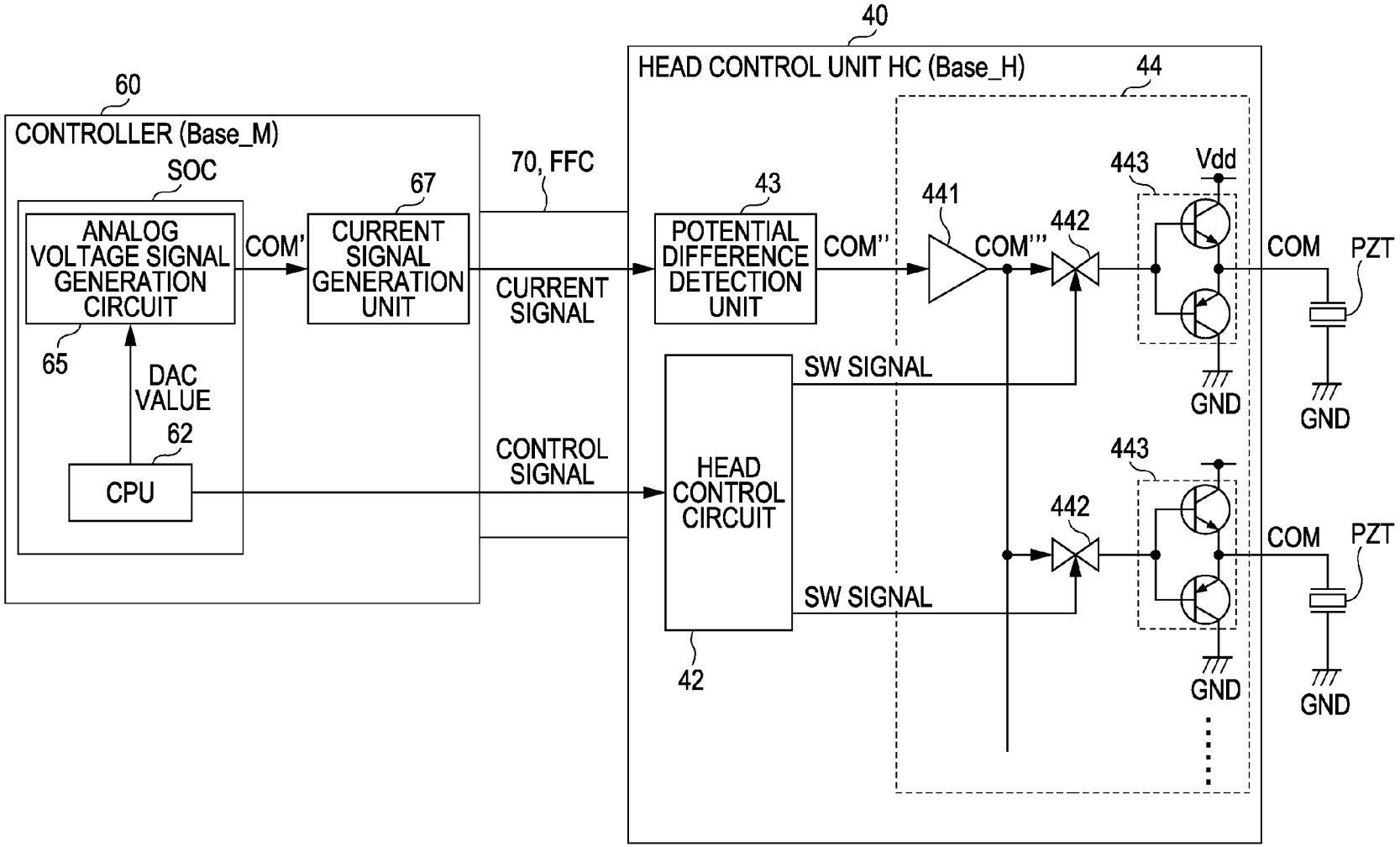
FIG. 4 is a diagram which describes configurations of a controller and a head control unit and operations thereof in the embodiment.

First, the configuration and operation of the head control unit HC will be described. FIG. 4 is a diagram which describes the configuration and operation of the controller 60 and the head control unit HC according to the embodiment.

The head control unit HC includes a head control circuit 42, a potential difference detection unit 43, and a drive waveform signal generation circuit 44, and is provided on the head substrate Base_H which is fixed to the head 41 (refer to FIG. 4). In addition, the drive waveform signal generation circuit 44 includes a voltage amplification unit 441, a switch 442, and a current amplification unit 443. In addition, only two piezoelectric elements PZT are depicted in FIG. 4, however, the printer 1 includes a plurality of piezoelectric elements in practice. In a configuration shown in FIG. 4, the switch 442 and the current amplification unit 443 are provided for each piezoelectric element PZT.

The head control unit 42 outputs a variety of signals of the transfer clock signal SCK which is transmitted from the controller 60, the latch signal LAT, the change signal CH, or the like, and a SW signal for controlling the switch 442 according to the pixel data SI.

The potential difference detection unit 43 detects the potential difference between two points in the transmission path which are different from each other with respect to the current signal which is transmitted from the current signal generation circuit 67 of the controller 60 through the FFC, and outputs the potential difference as a potential difference signal COM". According to the embodiment, the potential difference is detected using a detector having a predetermined resistance value. Specifically, the detector is provided in a path through which the current signal flows, and the difference in potential which is generated at both ends of the detector is detected when the current signal flows to the detector. In this manner, it is possible to detect the difference in potential simply and accurately. In addition, it is possible to use an element other than the detector when it is an element which can detect the difference in potential between two points of the current signal in the transmission path which are different from each other. For example, it is possible to detect the difference in potential using an element such as a transistor, and a photo transistor.

Figure 5:
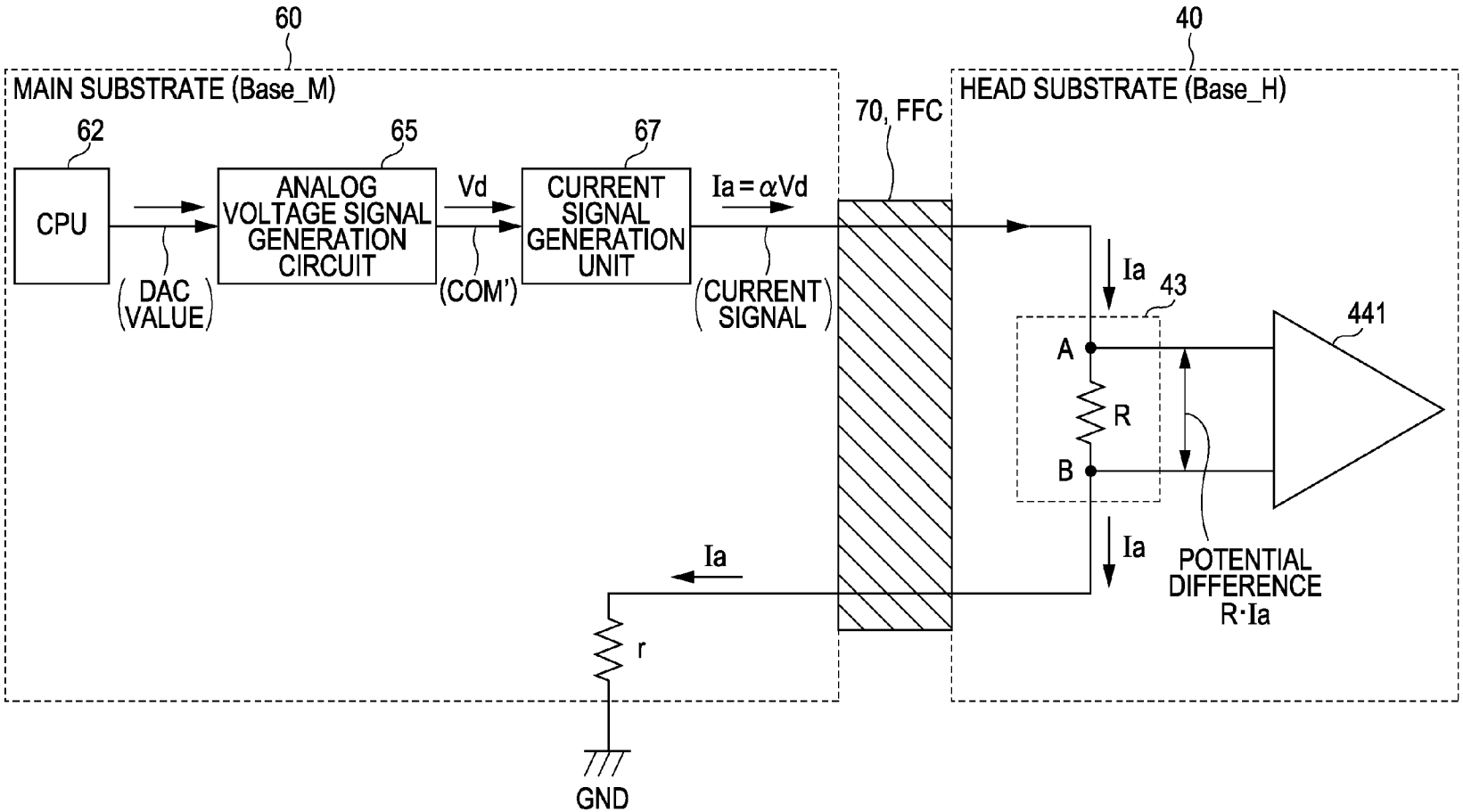
FIG. 5 is a diagram which describes a flow until a potentiometric signal is generated from a digital signal.

FIG. 5 is a diagram which describes a flow until the potential difference signal COM" is generated from the digital signal. First, the CPU 62 generates the digital signal (DAC value) which defines the shape of waveform of the drive waveform signal COM. Subsequently, the analog voltage signal generation circuit 65 generates the analog voltage signal COM' on the basis of the DAC value. A voltage value at a certain moment of the COM' is denoted by Vd. Subsequently, the current signal generation unit 67 performs the V/I conversion to the COM', and generates a current signal. As described above, the current value of the current signal is a value have a size corresponding to the voltage waveform of the COM', and, for example, the current value at a certain moment is denoted by Ia ($=\alpha \cdot Vd$). In this manner, the current value is controlled by the current signal generation unit 67 (current control), and is transmitted to the potential difference detection unit 43 which is provided in the head unit 40 through the transmission unit 70 (FFC) as a current signal.

Here, in a circuit to which the current flows, the sum total of the current which flows into an arbitrary point is equal to the sum of current which flows out (Kirchhoff's first law). Accordingly, when the current value which is current-controlled by the current signal generation unit 67 is Ia in a certain moment, in any points in the transmission path, the current value which flows in a certain moment is Ia.

In FIG. 5, when a resistor of which the resistance value R as the potential difference detection unit 43 is used, the potential difference of $R \cdot Ia$ is generated between a terminals A (input terminal of the current) and B (output terminal of the current) of the resistor. The potential difference signal COM" is generated by the potential difference between the terminals A and B. That is, the voltage value of the potential difference signal COM" is a value which is proportional to the current value of the current signal.

In addition, according to the embodiment, it is possible to suppress an occurrence of malfunction, or inability of sensing the input itself, due to the input of lower voltage than the GND to each element of a drive waveform signal generation circuit 44 to be described later. For example, it is possible to set the lowest voltage of B point to sufficiently higher than the GND, by providing an element such as a resistor between the point on the low potential side (B point) and the GND between two points (A point and B point in FIG. 5) which detect the potential difference. As shown in FIG. 5, by providing a resistor which has a resistance value of r between the B point and the GND, the potential at the B point as the point on the low potential side becomes $r \cdot Ia$, and is able to reliably have the higher potential than the that of the GND. In this manner, it is possible to easily suppress malfunctions of the drive waveform signal generation circuit 44. However, even if there is no resistor between the B point and the GND, it is possible to generate the drive waveform signal COM.

In addition, in FIG. 5, there is a path in the transmission unit 70 in which the current Ia returns to the main substrate Base-M, after flowing the resistance R. That is, the transmission unit 70 has a path in which the current signal is transmitted (return) to the controller 60 from the head unit 40. This path and a path which goes toward the head substrate Base_H from the main substrate Base_M becomes a so-called differential. Accordingly, it is possible to perform a strain-free transfer by matching the characteristic impedance of the resistance R and the transmission unit 70. In addition, when the path which goes toward the head substrate Base_H from the main substrate Base_M and a path which has the opposite direction thereto are close to each other, it is possible to obtain the differential transfer characteristic where the influence of noise can be further reduced, since the two paths are evenly influenced by the external noise.

The drive waveform signal generation circuit 44 generates the drive waveform signal COM as the voltage signal by performing voltage amplification or current amplification to the potential difference signal COM" based on the potential difference which is detected from the current signal, in the potential difference detection unit 43, and drives the piezoelectric element PZT by applying the drive waveform signal COM to the piezoelectric element PZT. That is, the drive waveform signal generation circuit 44 corresponds to the voltage signal generation unit (refer to FIG. 4).

The voltage amplification unit 441 generates a potential difference signal COM"' by amplifying the voltage of the potential difference signal COM". For example, a voltage of about 3 V is amplified to about 30 V as a necessary voltage for driving each piezoelectric element PZT. It is possible to use a general voltage amplification circuit in which the operational amplifier, or the like, is used, in the current amplification unit 431.

The switch 442 inputs the potential difference signal COM"' which is voltage-amplified in the voltage amplification unit 441 to the current amplification unit 443, according to the SW signal which is input from the head control circuit 42. For example, when the SW signal is H level, the switch 442 become ON state, and the potential difference signal COM"' is input to the current amplification unit 443. On the other hand, when the SW signal is L level, the switch 442 become OFF state, and the potential difference signal COM"' is not input to the current amplification unit 443.

The current amplification unit 443 receives the input potential difference signal COM"', generates the drive waveform signal COM by amplifying the current thereof, and applies the drive waveform signal COM to the piezoelectric element PZT. The current amplification unit 443 is configured by complementary connecting an NPN-type transistor and a PNP-type transistor to each other. A connector of the NPN-type transistor is connected to a main power supply Vdd, and a connector of the PNP-type transistor is connected to the ground (GND). In addition, it is possible to configure the current amplification unit 443 using an element other than the transistor.

In addition, the arrangement of the voltage amplification unit 441, the switch 442, and the current amplification unit 443 is not limited to the example shown in FIG. 4. For example, the position of the voltage amplification unit 441 and the switch 442 may be reversed, or the position of the switch 442 and the current amplification unit 443 may be reversed. However, in that case, it should be noted that it is necessary to appropriately change the number of voltage amplification units 441 and the current amplification units 443.

In addition, a capacitor is provided with an adequate capacity (not shown) in the head substrate Base-H, which is connected to the Vdd, therefore, it is possible to reduce a current capacity of the transmission unit 70, since there is no significant current flowing to the transmission unit 70 because of the instantaneous current which is supplied from the capacitor, even if a large current flows to a lot of piezoelectric elements PZT at the same time.

Figure 6:
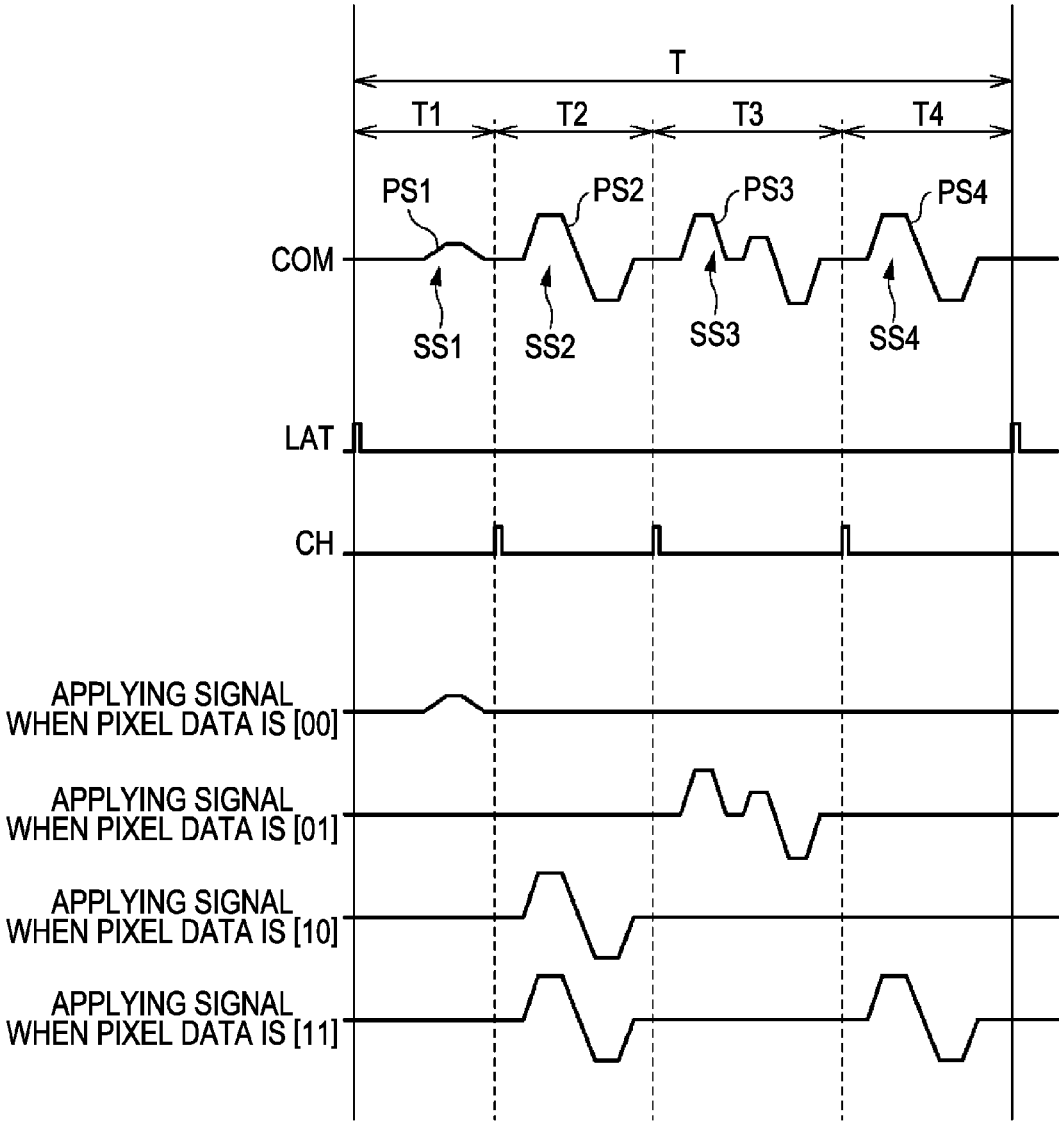
FIG. 6 is a diagram which describes a drive waveform signal.

FIG. 6 shows a diagram which describes the generated drive waveform signal COM. As shown in the figure, the drive waveform signal COM is generated by setting a period T, in which the rise timing of the latch signal is set to a break, as one unit. In the period T, intervals T1 to T4 which are divided by the latch signal LAT, or the rise timing of the change signal CH are included. In addition, the intervals T1 to T4 include respective driving pulses to be described later. The period T as the cycle period corresponds to a period during when the nozzle moves by one pixel. For example, in a case of the print resolution of 720 dpi, the period T corresponds to a period during when the nozzle moves by 1/720 inches. In addition, on the basis of the pixel data SI, the ink amount which is ejected from the nozzle is adjusted by applying the driving pulses PS1 to PS4 of each interval which are included in the period T to the piezoelectric element PZT, thereby enabling the expression of images which are formed of a plurality of grayscale.

The drive waveform signal COM includes a first corrugation SS1 which is generated in the interval T1, a second corrugation SS2 which is generated in the interval T2, a third corrugation SS3 which is generated in the interval T3, and a fourth corrugation SS4 which is generated in the interval T4. Here, the fist corrugation SS1 includes the driving pulse PS1. In addition, the second corrugation SS2 includes the driving pulse PS2, the third corrugation SS3 includes the driving pulse PS3, and the fourth corrugation SS4 includes the driving pulse PS4, respectively.

Each driving pulse is the voltage waveform, and is generated using the potential difference between the main power supply Vdd and the ground (GND).

In a case where the pixel data SI is [00], the first interval signal SS1 of the drive waveform signal COM is applied to the piezoelectric element PZT, and the piezoelectric element PZT is driven by the driving pulse PS1. When the piezoelectric element PZT is driven corresponding to the driving pulse PS1, a pressure fluctuation of a level not causing the ink ejection is generated in the ink, and ink meniscus (free surface of the ink which is exposed to the nozzle portion) is minutely vibrated.

In a case where the pixel data SI is [01], the third interval signal SS3 of the drive waveform signal COM is applied to the piezoelectric element PZT, and the piezoelectric element PZT is driven by the driving pulse PS3. When the piezoelectric element PZT is driven corresponding to the driving pulse PS3, a small amount of ink is ejected, and a small dot is formed on the medium.

In a case where the pixel data SI is [10], the second interval signal SS2 of the drive waveform signal COM is applied to the piezoelectric element PZT, and the piezoelectric element PZT is driven by the driving pulse PS2. When the piezoelectric element PZT is driven corresponding to the driving pulse PS2, a moderate amount of ink is ejected, and a medium dot is formed on the medium.

In a case where the pixel data SI is [11], the second interval signal SS2 and the fourth interval signal SS4 of the drive waveform signal COM is applied to the piezoelectric element PZT, and the piezoelectric element PZT is driven by the driving pulse PS2 and the driving pulse PS4. When the piezoelectric element PZT is driven corresponding to the driving pulse PS2 and the driving pulse PS4, a large dot is formed on the medium.

Regarding Effect when Current Signal is Transmitted

First, as a comparison example, a case will be described, where an analog voltage signal COM' which is generated in an analog voltage signal generation circuit 65 is not converted to a current signal, and is transmitted to a head unit 40 as is, thereby generating a drive waveform signal COM, and performing printing.

Figure 7:
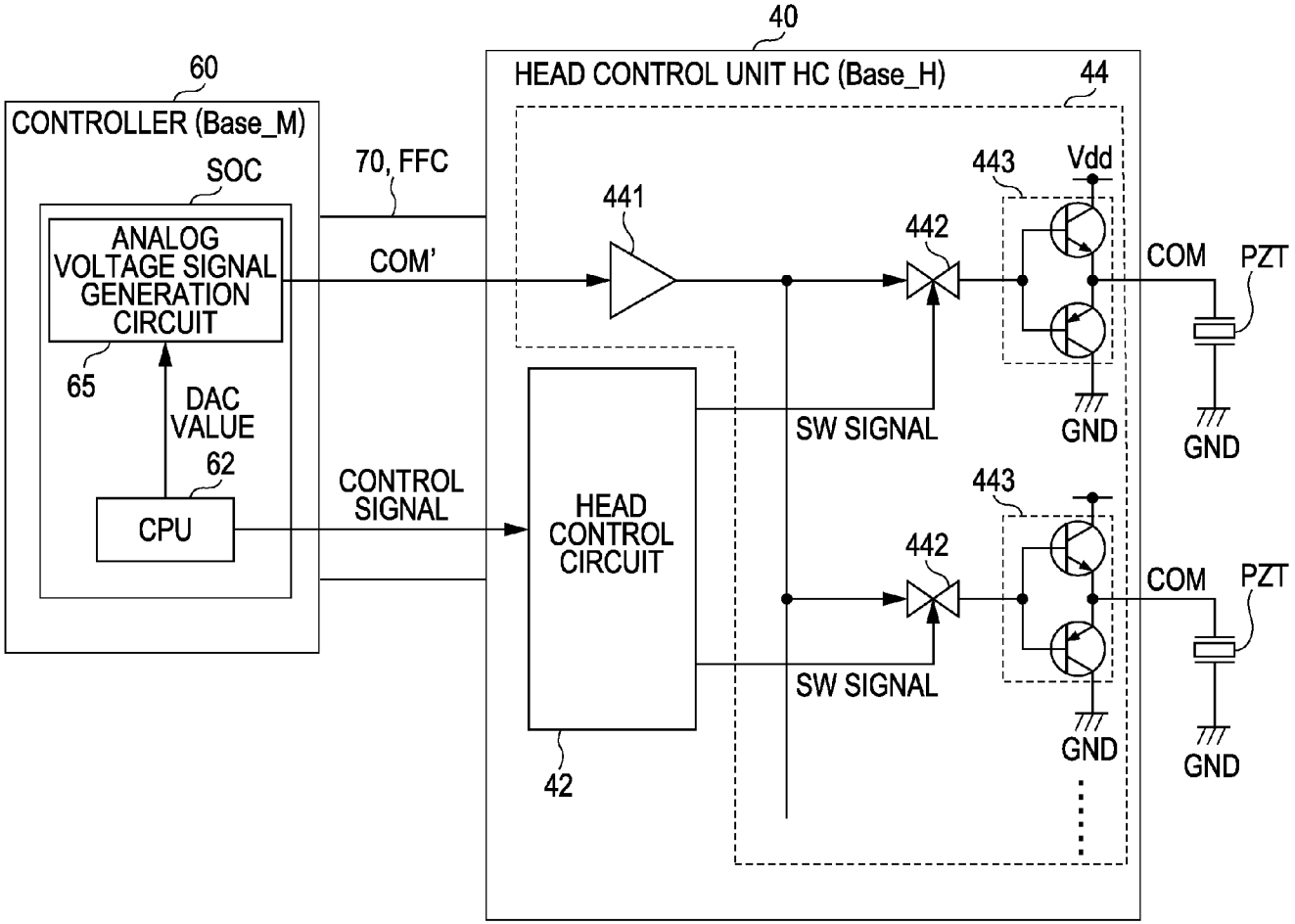
FIG. 7 is a diagram which describes configurations of a controller and a head control unit and operations thereof in a comparison example.

FIG. 7 is a diagram which describes a configuration and operation of a controller 60 and a head control unit HC in the comparison example. A printer in the comparison example does not include a current signal generation unit 67 and a potential difference detection unit 43. The other configuration than that is basically the same as that of the printer 1 according to the embodiment.

In the comparison example, the analog voltage signal COM' is directly transmitted to a drive waveform signal generation circuit 44. At this time, since the analog voltage signal COM' is transmitted in the relatively long distance in FFC (transmission unit 70) which connects between a main substrate Base_M of the controller 60 and a head substrate Base-H of the head unit 40, the analog voltage signal COM' may be influenced by noise while being transmitted through the FFC. Since the COM' is an analog signal, it is susceptible to disturbance and distortion of the shape of the voltage waveform if influenced by the noise. When the shape of the COM' is subject to the disturbance and distortion, it is difficult to control the amount of ink droplets, or velocity of the ink ejected from a piezoelectric element PZT, since the waveform of a drive waveform signal COM which is generated on the basis of the COM' is also deformed.

Accordingly, in the case of the comparison example, there is a problem in that it is difficult to generate the accurate drive waveform signal COM, since the analog voltage signal COM' for generating the drive waveform signal COM is influenced by the noise when being transmitted in the FFC.

In contrast to this, according to the embodiment, as shown in FIG. 4, a current signal is generated by performing V/I converting to the analog voltage signal COM' in the current signal generation unit 67, and is transmitted in the FFC as the current signal. As described above, since a current value is equal at any point in a certain circuit, the current value itself is the same value as each other. In addition, since the current value of the current signal is controlled by the current signal generation unit 67, if a predetermined current value is output in an exit of the current signal generation unit 67, even if the current signal is influenced by the noise during transmitting in the FFC, the current signal has the same value at any point in the circuit thereafter.

For example, in FIG. 5, when the current value of a current signal at a moment when being output from the current signal generation unit 67 is denoted by Ia, the current value is the same current value Ia, even at an input terminal A of a potential difference detection unit 43 after being transmitted in the FFC. In addition, the current value is Ia, even at an output terminal B of the potential difference detection unit 43. Accordingly, even if the current signal is influenced by the noise during transmission in the FFC, the potential difference between the terminals A and B which is detected in the potential difference detection unit 43 is R·Ia.

In addition, as shown in FIG. 5, since the signal is transmitted on the differential, the signal has the advantage of the differential transmission.

That is, according to the embodiment, since a voltage value which is detected as a voltage in between the terminals A and B is a value which is not influenced by the noise, the drive waveform signal COM which is generated by amplifying the voltage between both the terminals can also be referred to as a signal which is nearly not influenced by the noise. In this manner, it is possible to generate the drive waveform signal COM which is resistant to disturbance and accurate, and to control the driving of the piezoelectric element PZT precisely.

Conclusion

According to the embodiment, the DAC value as the digital signal which defines the shape of the waveform of a predetermined signal is generated in the CPU 62, the analog voltage signal COM' is generated in the analog voltage signal generation circuit 65 on the basis of the DAC value, and a current signal of a magnitude corresponding to the waveform of the analog voltage signal COM' is generated in the current signal generation unit 67. The generated current signal is transmitted to the head unit 40 from the control unit 60 through the FFC. The potential difference of the transmitted current signal in between two different points is detected in the current path in the potential difference detection unit 43, the potential difference is subject to voltage amplification and current amplification in the drive waveform signal generation circuit 44, thereby generating the drive waveform signal COM. In addition, the ink is ejected by applying the drive waveform signal COM, and driving the piezoelectric element PZT.

There is a possibility of the current signal being influenced by the noise during transmission in the FFC, however, the current value itself of the current signal is equal at any point in the circuit, it is possible to detect the potential difference between two different points in the current path as a value which is proportional to the current value without being influenced by the noise. Accordingly, it is possible to generate the drive waveform signal COM which is resistant to disturbance and accurate by amplifying the potential difference.

Other Embodiment

The printer or the like has been described, as one embodiment, however, the above described embodiment is only for making the invention easy to be understood, and is not interpreted as limiting the invention. The invention can be changed or modified without departing from the spirit of the invention, and includes the equivalents thereof. Particularly, even the embodiment described below is included in the invention.

Regarding Liquid Ejection Apparatus

In each embodiment which is described above, a printer has been described as an example of the liquid ejection apparatus, however, the printer is not limited thereto. For example, it is possible to apply the same technology as that of the embodiment to various liquid ejection apparatuses to which the ink jet technology is applied, such as, a color filter manufacturing device, a coloring device, a micro-fabricated device, a semiconductor manufacturing device, surface treatment equipment, a 3D modeling device, a liquid vaporizing device, an organic EL manufacturing device (particularly, polymer EL manufacturing device), a display manufacturing device, film formation equipment, a DNA chip manufacturing device, or the like.

Regarding Piezoelectric Element

In each embodiment described above, the piezoelectric element PZT was exemplified as the element which performs the operation for ejecting liquid, however, the element may be other elements. For example, a heater element, or an electrostatic actuator may be used.

Transistor of Current Amplification Unit 443

In each embodiment described above, the NPN-type transistor and the PNP-type transistor were exemplified as the transistors included in the current amplification unit 443. However, other types of transistors may be used if they are transistors which perform the current amplification with respect to the analog voltage signal COM'.

Regarding Other Devices

In each embodiment described above, the type of ink jet printer which moves the head 41 along with the carriage (a serial printer) was exemplified, however, the printer may be a so-called line printer of which the head is fixed.

What is claimed is:

1. A liquid ejecting apparatus comprising:

(A) a control unit including, a digital signal generation unit which generates a digital signal defining the shape of the signal waveform;

an analog voltage signal generation unit which generates an analog voltage signal on the basis of the digital signal; and a current signal generation unit which generates a current signal of a magnitude corresponding to a waveform of the analog voltage signal, (B) a head unit including, a voltage signal generation unit which generates a voltage signal by detecting a potential difference between two points which are different from each other in a path through which the current signal flows, and by amplifying the potential difference; and an element which is driven by the voltage signal, and causes liquid to be ejected from a nozzle, and (C) a transmission unit which transmits the current signal to the head unit from the control unit.

2. The liquid ejecting apparatus according to claim 1, wherein a potential of a point of lower potential side is set to be higher than a potential of GND, between the two different points which detect a potential difference.

3. The liquid ejecting apparatus according to claim 1, wherein the transmission unit has a path in which the current signal which is transmitted to the head unit from the control unit returns to the control unit from the head unit.

4. The liquid ejecting apparatus according to claim 1, wherein the control unit has a chip in which the digital signal generation unit and the analog voltage signal generation unit are integrally formed.

5. The liquid ejecting apparatus according to claim 1, wherein the control unit has a chip in which the digital signal generation unit, the analog voltage signal generation unit, and the current signal generation unit are integrally formed.

6. The liquid ejecting apparatus according to claim 1, further comprising:

a resistor in a path through which the current signal flows, wherein a difference in a potential which is generated at both ends of the resistor is detected when the current signal flows through the resistor.

7. A liquid ejecting method comprising:

generating a digital signal which defines the shape of a signal waveform;

generating an analog voltage signal on the basis of the digital signal;

generating a current signal of a magnitude corresponding to the waveform of the analog voltage signal;

transmitting the generated current signal to a head unit;

generating a voltage signal by detecting a potential difference between two different points of a path to which the current signal flows, and by amplifying the potential difference, in the head unit; and causing liquid to be ejected from a nozzle by driving an element using the voltage signal.

* * * * *